US008261765B2

(12) United States Patent
Wauters et al.

(10) Patent No.: US 8,261,765 B2
(45) Date of Patent: Sep. 11, 2012

(54) VALVE ASSEMBLY

(75) Inventors: Albert Wauters, Destelbergen (BE); Iain McDerment, Melbourne (GB)

(73) Assignee: Anheuser-Busch InBev S.A., Brussels (BE)

( * ) Notice: Subject to any disclaimer, the term of this patent is extended or adjusted under 35 U.S.C. 154(b) by 392 days.

(21) Appl. No.: 12/449,483

(22) PCT Filed: Feb. 12, 2008

(86) PCT No.: PCT/EP2008/051686

§ 371 (c)(1),
(2), (4) Date: Aug. 11, 2009

(87) PCT Pub. No.: WO2008/098936

PCT Pub. Date: Aug. 21, 2008

(65) Prior Publication Data

US 2010/0116356 A1 May 13, 2010

(30) Foreign Application Priority Data

Feb. 12, 2007 (GB) ..... 0702679.2
Dec. 14, 2007 (GB) ..... 0724454.4

(51) Int. Cl.
*B67D 7/72* (2010.01)

(52) U.S. Cl. ..... 137/212; 251/149.6; 92/103 R

(58) Field of Classification Search ..... 137/212, 137/317, 614.02–614.06; 251/149.1–149.9; 92/103 R See application file for complete search history.

(56) References Cited

U.S. PATENT DOCUMENTS

| | | | | |
|---|---|---|---|---|
| 3,353,724 | A * | 11/1967 | Johnston | 222/400.7 |
| 3,422,448 | A * | 1/1969 | Johnston | 222/400.7 |
| 3,776,260 | A * | 12/1973 | Ruddick | 137/321 |
| 4,159,102 | A * | 6/1979 | Fallon et al. | 251/149.6 |
| 4,665,940 | A * | 5/1987 | Jacobson | 137/212 |
| 4,717,048 | A * | 1/1988 | Stenger | 222/400.8 |
| 5,090,599 | A * | 2/1992 | Stenger | 222/400.7 |

FOREIGN PATENT DOCUMENTS

| | | |
|---|---|---|
| EP | 2104635 | 8/1972 |
| EP | 0225035 | 6/1987 |
| EP | 0493976 | 7/1992 |

* cited by examiner

*Primary Examiner* — John Rivell
*Assistant Examiner* — Matthew W Jellett
(74) *Attorney, Agent, or Firm* — Levy & Grandinetti

(57) ABSTRACT

A diaphragm for use in a valve assembly, comprising at least one sealing portion and a fixation portion, characterized in that the fixation portion and the at least one sealing portion are connected by a flexible portion.

16 Claims, 6 Drawing Sheets

VALVE ASSEMBLY

The Applicants claim priority to International Application Number PCT/EP2008/051686, filed on Feb. 12, 2008, Great Britain Application Number 0724454.4, filed on Dec. 14, 2007, and Great Britain Application Number 0702679.2, filed on Feb. 12, 2007.

FIELD OF THE INVENTION

The present invention relates to a diaphragm for use in a valve assembly, in particular valve assemblies adapted to concurrently pass valve segregated streams, (i.e. during dispense operation).

BACKGROUND OF THE INVENTION

At present, the valve assemblies used for beer kegs can be categorized in two major types.

A first type, the so called A(lumasc) type, is described in for example WO 0020326 and comprises a cylindrical housing and a cylindrical, cup-shaped base fitted in the open bottom of the housing.

The top of the housing has an inwardly directed annular rim defining an outer peripheral valve seat of the valve port, while in the cylindrical side wall of the housing a series of ports is provided.

The cup-shaped base is provided with a central spigot extending both upward and downward from the base. A valve stem is fitted in the upper part of the spigot. This valve stem is a tubular member provided with a cap at one end and with a series of ports in the tubular side wall adjacent to that cap. The valve stem partially extends out of the spigot such that said series of ports is free.

The cap of the valve stem has an outwardly directed annular rim defining an inner peripheral valve seat coplanar with the outer peripheral valve seat.

A poppet-ring valve member made of a resilient material is provided coaxially around the valve stem and is actuated against the valve seats by means of a spring provided in the valve housing.

The poppet-ring hereby allows sealing the valve port in a closed position. To open the valve port, a dispenser tube is used to press the poppet-ring against the spring past the series of ports in the valve stem. In this open position, the dispenser tube, the valve member and the spigot segregate an internal and external fluid channel.

A second type of valve assemblies is generally named the S(ankey) type and is described in for example GB 1549733. S-type valve assemblies comprise a cylindrical housing and a cup-shaped base movably fitted therein.

The top of the housing has an inwardly directed rim defining an outer peripheral seat of the valve port, while the base of the housing has an inwardly directed flange defining a hole wherein the cup-shaped base is slidebly mounted in a sealing manner.

The cup-shaped base consists of a tubular member with at least one alteration in diameter created by a shoulder portion in the side walls thereof. At its top, the cup-shaped bas has an outwardly extending flange provided with a sealing. The cup-shaped base is actuated by a spring fitted between the base of the housing and the flange at the top of the cup-shaped base, thereby pushing the sealing against the outer peripheral valve seat, closing the outer fluid channel.

In the cup-shaped base is provided a valve plug usually consisting of an integral disc-shaped body with a peripheral transversal flange. The outer peripheral edge of the valve plug defines the inner peripheral valve seat.

A second spring is applied between the valve plug and the shoulder portion in the cup-shaped base, thereby pressing the valve plug against the inner valve seat and closing the inner fluid channel of the valve.

A drawback of the A-type valve assemblies is that the overall design with spigot and cup-shaped base necessitates a substantial amount of material, thereby rendering this type of valve assemblies heavy and expensive.

Another drawback of the A-type valve assemblies is that the sealing is slideble in view of the spigot, while contact between both parts is essential for the segregation between both fluid channels.

An drawback of the known S-type valves is the use of two springs, which render this type of valve quite expensive, both in material cost and in assembly cost. Moreover the fact that the cup-shaped base is movable with respect to the valve housing renders the assembly of the valve rather complex.

EP 0225035 discloses an alternative design allowing replacement of the springs by elastomeric materials. However, the proposed design is rather complex and the cup-shaped base still is slidebly mounted in the valve housing such that assembly of the valve remains complex and expensive.

The object underlying the present invention is to solve the above drawbacks and to present a valve assembly that is more easy to manufacture and reliable in use.

SUMMARY OF THE INVENTION

The present invention meets the above objectives by providing a diaphragm for use in a valve assembly, comprising at least one sealing portion and a fixation portion, characterized in that the fixation portion and the at least one sealing portion are connected by a flexible portion.

As will be described in more hereafter, the use of the above valve assembly allows achieving a reliable segregation between the fluid channels for both the A-type and S-type valve assemblies, whereby the diaphragm performs as a sealing that is rigidly fixed to the spigot or cup-shaped base.

Another advantage of the diaphragm is that the design thereof allows reducing the material needed for manufacturing the valve assembly, thereby reducing its cost.

Yet another advantage is that for the S-type valve assemblies, the cup-shaped base can be rigidly fixed to the housing and only necessitates the use of one single spring, thereby reducing both manufacturing and assembly cost, while improving reliability.

The invention also concerns a valve assembly comprising a diaphragm as identified above as well as kegs and in particular beer kegs comprising a valve assembly with the identified diaphragm incorporated therein.

INTRODUCTION TO THE DRAWINGS

In order to better show the characteristics of the present invention a detailed description will a preferred embodiment will be given hereafter, as an example only, without limiting the scope of the present invention and with reference to the appended drawings, wherein.

Figure 1:
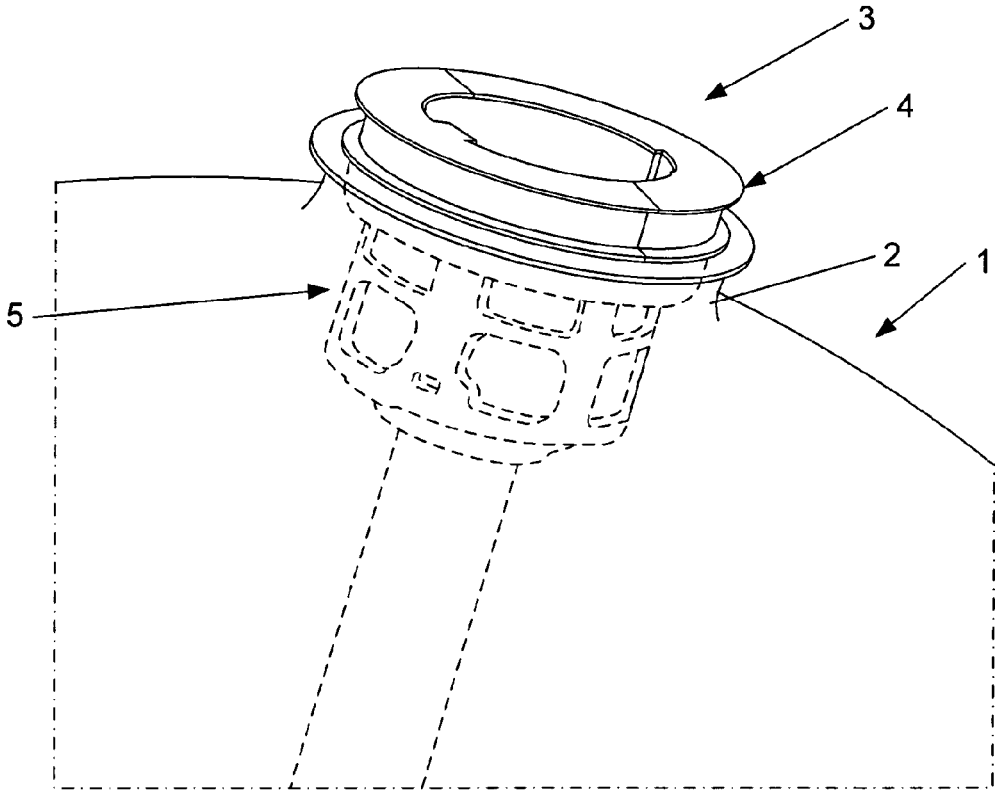
FIG. 1 represents a partial view of a keg having a neck portion with an S-type valve assembly fitted therein.
Figure 2:
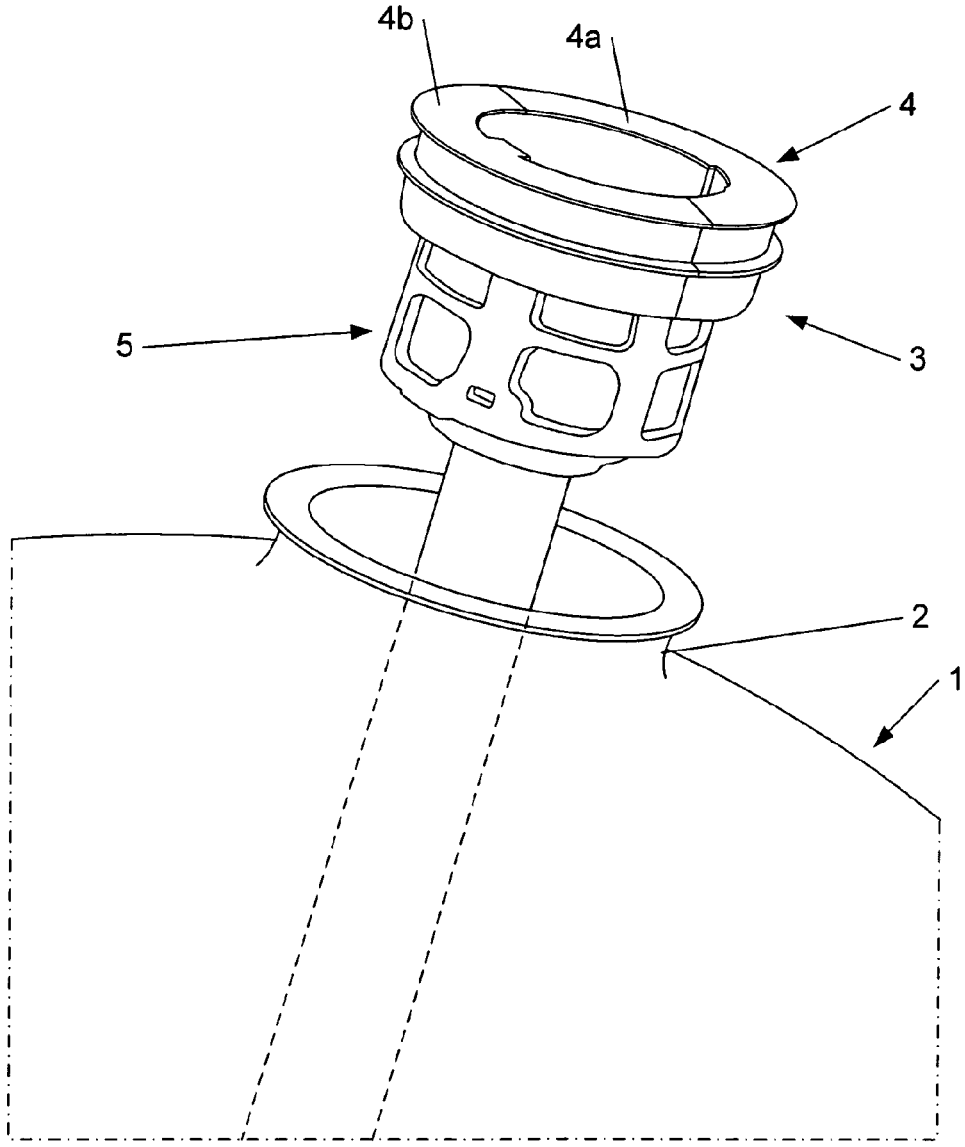
FIG. 2 represents the same parts as FIG. 1 though in an exploded view.
Figure 3:
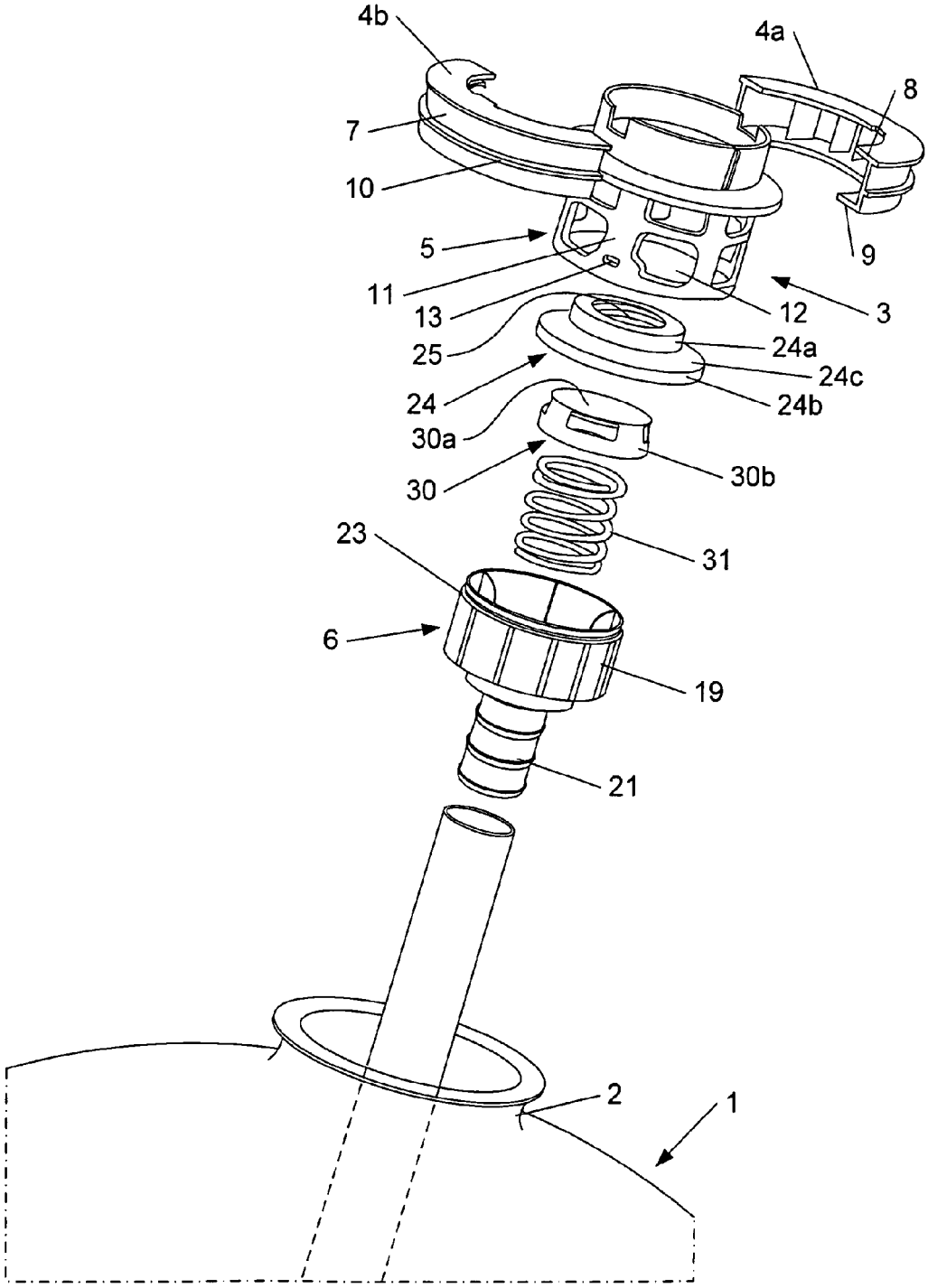
Figure 4:
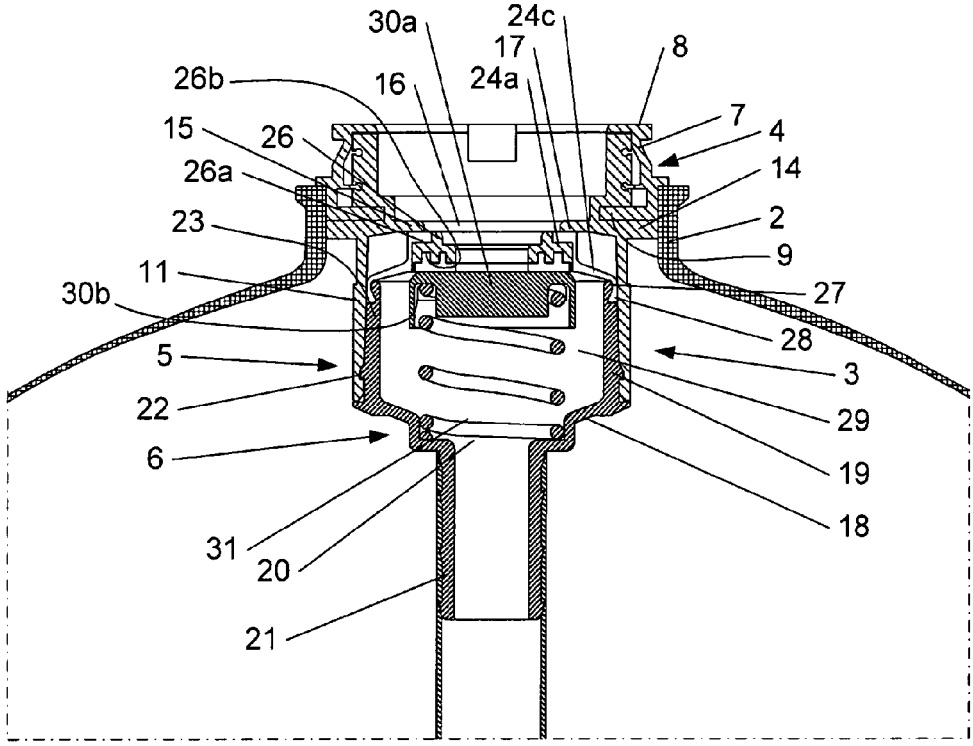
Figure 5:
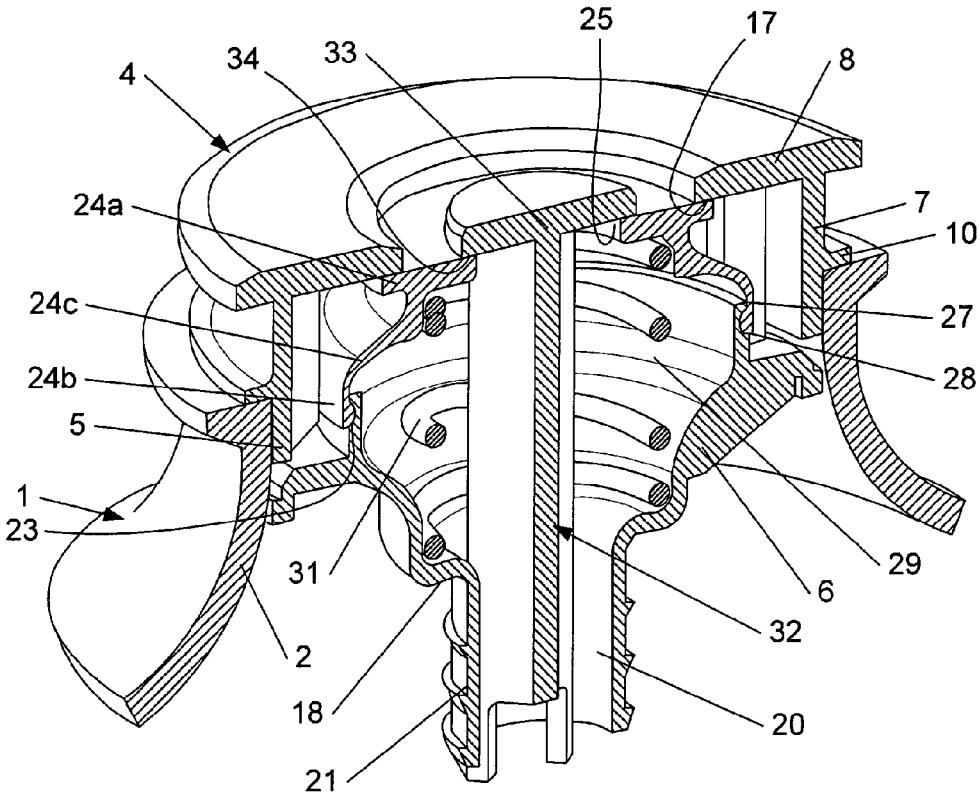
Figure 6:
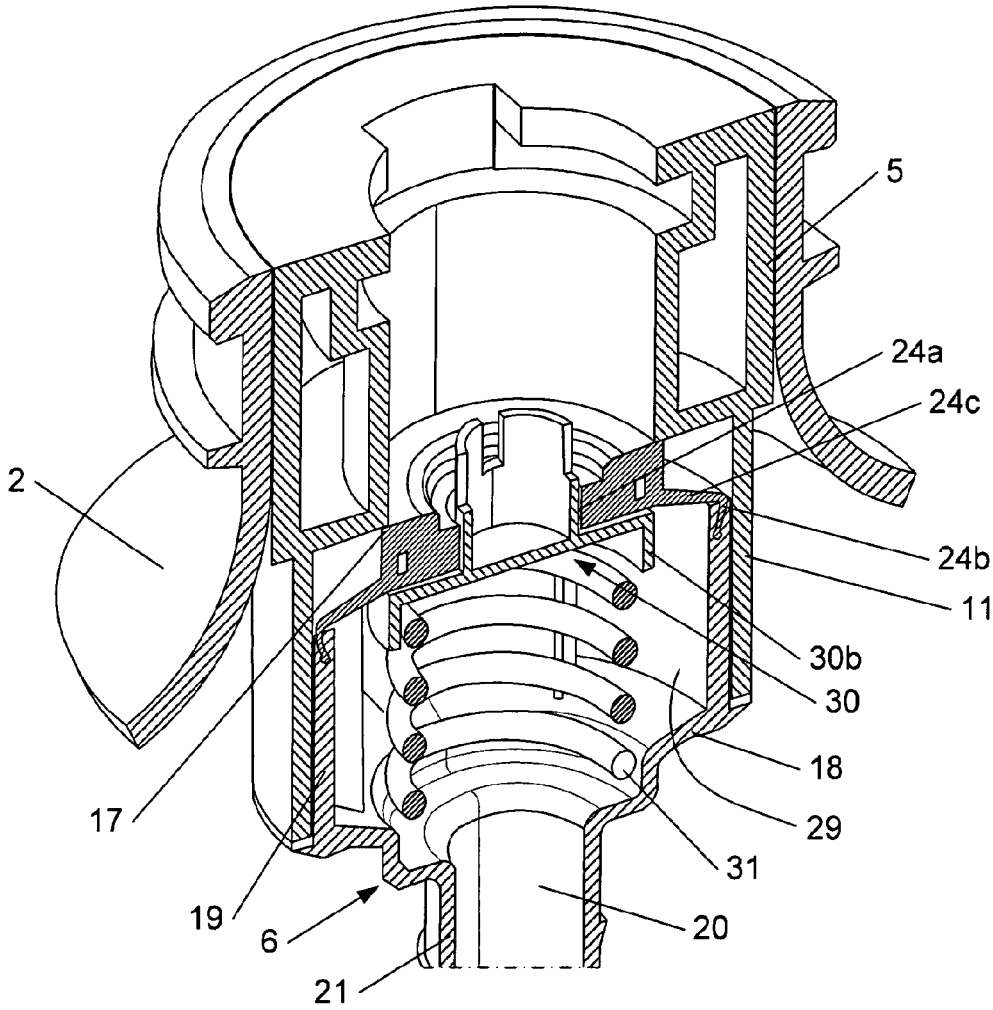

FIG. 3 on a smaller scale represents a further exploded view of FIG. 2;

FIG. 4 represents a cross-section according to line IV-IV in FIG. 1;

FIGS. 5 and 6 represent cross-sections of alternative valve assemblies according the invention.

DETAILED DESCRIPTION OF THE PRESENT INVENTION

FIG. 1 represents a keg 1, for example a beer keg, provided with a neck portion 2 wherein a valve assembly 3 according to the invention is fixed.

In the embodiment shown in FIGS. 1 to 4, the valve assembly 3 according to the invention is designed as an S-type assembly and comprises a fitting 4, a housing 5 and a cup-shaped base 6.

In the present embodiment the fitting 4, which in this case is annular, consists of two semi-circular profiles 4*a*, 4*b* each having a semi-cylindrical plate 7 provided with an inwardly and outwardly extending flange 8 at its top and with an inwardly directed flange 9 at its bottom. Intermediate between top and bottom is provided an outwardly extending flange 10.

The housing 5, which in this case is cylindrical, comprises a cylindrical wall portion 11 provided with a series of ports 12 and fixation holes 13. At its top, the cylindrical wall portion 11 is provided with an outwardly extending flange 14 and in inwardly directed rim 15 defining the valve port 16 and the outer peripheral valve seat 17.

The cup-shaped base 6, which in the represented embodiment is cylindrical, comprises an annular base part 18 and a cylindrical wall 19 provided thereon. In the base is provided a central hole 20.

Preferably a tube 21 is fixed to the edges of said hole 20, which tube extends in a direction away from the cylindrical wall 19 of the cup-shaped base 6. In the present embodiment that cylindrical wall 19 is provided with a number of protrusions 22 and with a groove 23, in this case an annular groove 23, provided near the free end at the outer surface of the wall 19.

It is noted that the fitting 4, the housing 5 and the cup-shaped base can be made of thermoplastic material such as PET or PEN. Manufacturing all these components in a same or similar material facilitates recycling of the valve assembly.

According to the present invention a diaphragm 24 is fixed to the cup-shaped base 6, which diaphragm 24 at least comprises at least one sealing portion 24*a*; a fixation portion 24*b*; and a flexible portion 24*c* connecting the sealing portion 24*a* to the fixation portion 24*b*.

The diaphragm 24 is preferably manufactured out of an elastomeric material such as for example Hytrel™ (Du Pont) or Dryflex® (VTC TPE Group).

The diaphragm has a general cylindrical form defining a central opening 25. The sealing portion 24*a* preferably comprises a rigid ring structure 26 with an inner peripheral diameter inferior to the inner peripheral diameter of the valve port 16 and with an outer peripheral diameter superior to the diameter of the valve port 16.

The rigid structure 26 is at least partially overmoulded with the elastomeric material of the diaphragm 24. In this case the overmoulded parts of the rigid structure 26 are situated at both top side 26*a* and bottom side 26*b* of thereof.

At the outer perimeter of the sealing portion, the diaphragm extends outwardly by what can be defined as a flexible portion 26*c* that in this case is formed by a continuous sheet like annular ring of elastomeric material.

It is essential for the invention that this portion of the diaphragm is flexible. How the flexible character is achieved is less important and it is noted that the flexibility is achieved by employing a corrugated material or whatsoever. In case of a two-channel valve, the flexible portion needs to be continuous as it is part of the segregation between both channels in the valve. In fact, the diaphragm can be considered as part of the cup-shaped base 6, wherein a first inner fluid channel is defined at the inside of that base 6 and wherein a second outer fluid channel is defined in the housing 5, but outside the base 6.

The fixation portion 24*b* is provided at the outer perimeter of the flexible portion 24*c* and preferably comprises fixation means that in this case are formed by a shoulder 27 from whereon the diaphragm 24 extends in an approximately longitudinal direction with respect to the annular design thereof.

At the free end of the diaphragm 24 is provided an inwardly directed rim 28 that can be engaged in the above mentioned groove 23 in the cup-shaped base 6 to be fixedly attached thereto.

As will be appreciated from FIG. 4, the diaphragm 24 and cup-shaped base 6 define a space 29, wherein are provided a valve plug 30 and a spring 31. The valve plug preferably consists of an integral disc-shaped body 30*a* with a peripheral transversal flange 30*b*. The disc-shaped body 30*a* hereby defines an inner peripheral valve seat and has a diameter that is preferably superior to the inner diameter of the rigid ring structure 26 of the diaphragm 24.

The spring 31, which is preferably made of stainless steel, is biased between the base part 18 and the valve plug 30, thereby pressing the valve plug 30 or inner valve seat against the sealing portion 24*a* of the diaphragm 24.

In an assembled condition the cup-shaped base 6 is engaged in the housing 5 by means of the protrusions 22 of the cup-shaped base 6 snapping in the holes 13 in the housing 5, such that the base 6 is rigidly fixed to the housing 5.

It is noted that the dimensions of the cup-shaped base 6 and housing 5 are such that the wall portion 11 and the wall 19 of the cup-shaped base 6 closely fit, such that the fixation portion 24*b* of the diaphragm 24 is clamped between both walls 11 and 19.

The housing 5 itself is fixed between the inwardly extending flanges 8 and 9 of the annular fitting 4, that on its turn can be fixed to the neck portion 2 of a keg 1.

In this case the annular fitting 4 and in particular its flange 10 is laser welded to the neck portion, although the fixation can also be achieved by a clamp of thread. Such methods of fixations are generally known in the field of invention and will not be described in further detail.

The actuation of the valve assembly 24 is simple and as follows.

In a non-actuated state, the valve assembly is in a closed position. Indeed, in a non-actuated position, the valve plug 30 is pressed against the sealing portion 24*a* of the diaphragm 24, which at its turn is pushed against the outer peripheral valve seat 17 thereby shutting the valve port in a sealing manner.

To open the valve port, a dispenser device is connected in a sealing manner on the neck portion of the keg 1, while a dispenser tube, slidingly mounted in the dispenser device is positioned with its tip centrally in front of the valve port 16. Presently known dispenser tubes for S-type valves are provided with a sealing shoulder at a distance of their tip. When moving the tube towards the valve, the tip engages the valve plug 30 and compresses the spring 31, while the shoulder engages in a sealing manner the sealing portion 24*a* of the diaphragm 24.

In this way, a first outer valve channel is created that is defined by the outer surface of the dispenser tube, the outer surface of the diaphragm 24 and the inner surface of the housing 5. This outer channel has access to the keg 1 via the above mentioned series of ports 12 in the valve housing 5. A second valve inner channel is defined by the interior of the dispenser tube, the inner surface of the diaphragm 24 and the inner wall of the cup-shaped base 6.

For beer kegs, the inner valve channel is traditionally for guiding beer out of the keg 1, while the outer valve channel is used for guiding a pressurized fluid like gas in the keg 1, thereby forcing the beer out.

Once the dispenser tube is removed, the spring 31 will force the valve plug 30 to a closed position, thereby forcing the sealing portion 24*a* of the diaphragm 24 to abut the outer peripheral valve seat 17 and thus shutting the valve port 16.

FIG. 5 represents an alternative valve assembly according to the invention. This variant is designed in accordance with the A-type valve assemblies.

The difference, wherein the valve plug 30 is replaced by a valve stem 32 that is fitted in the cup-shaped base 6 and that is provided with a cap 33. This cap 33 has an outwardly directed annular rim 34 defining an inner peripheral valve seat coplanar with the outer peripheral valve seat 17.

The overall design of the diaphragm 24 corresponds to the diaphragm according to the invention designed for the S-type valve assembly.

However, with respect to the sealing portion 24*a* of the diaphragm 24, it is clear that, since in the A-type valve assemblies the inner and outer peripheral valve seats are coplanar, the design of the rigid ring structure 26 is adapted accordingly.

In the embodiment represented in the FIG. 5 the cup-shaped base 6 has an outer diameter that is significantly smaller than the inner diameter of the housing 5 that is made in one piece with the annular fitting. Although this is only a design option, the above characteristic has an implication on the fixation of the diaphragm to the cup-shaped base 6. Indeed, in this embodiment, the fixation portion 24*b* of the diaphragm can not be clamped between the walls 11, respectively 19, of the housing 5 and the cup-shaped base 6.

Therefore, a clamp ring (not shown) can be applied. It is clear however that both for the S-type as the A-type valve assemblies, the fixation of the diaphragm 24 can be achieved according numerous alternatives, such as welding or gluing the fixation portion 24*b* to the cup-shaped base 6.

FIG. 6 finally represents an alternative S-type variant valve assembly according to the invention. This type of valve assembly, that can be categorized as a G-subtype valve assembly, differs from the valve assembly represented in FIGS. 1 to 4, in that the part of the housing 5 that normally fits in the annular fitting 4 is designed to engage immediately in the neck portion 2 of the keg 1. The valve plug 30 is also slightly amended but the design changes do in no way affect the functioning of the valve assembly, nor does it affect the cooperation of the valve plug 30 with the diaphragm 24.

The present invention is by no means limited to the preferred embodiments of the diaphragm or valve assembly described here above, but on the contrary can be made in multiple variations without leaving the scope of the present invention.

REFERENCES

1. Keg
2. Neck portion
3. Valve assembly
4. Annular fitting
  a. semicircular profile
  b. semicircular profile
5. Housing
6. Cup-shaped base
7. Semi-cylindrical plate
8. Flange
9. Flange
10. Flange
11. Wall portion
12. Ports
13. Holes
14. Flange
15. Rim
16. Valve port
17. Outer valve seat
18. Annular base part
19. Wail seat
20. Hole
21. Tube
22. Protrusions
23. Groove
24. Diaphragm
  a. Sealing portion
  b. Fixation portion
  c. Flexible portion
25. Opening
26. Rigid ring structure
27. Shoulder
28. Rim
29. Space
30. Valve plug
  a. Body
  b. Flange
31. Spring
32. Valve Stem
33. Cap
34. Rim/inner peripheral valve seat

The invention claimed is:

1. A diaphragm for use in a valve assembly of the type comprising a housing with a valve seat surrounding a valve port and a base engaged in close fit in the housing, said diaphragm comprising:

(a) at least one sealing portion suitable for sealingly fitting the valve seat, said sealing portion comprising a central opening facing the valve port.

(b) a fixation portion suitable for fixing said diaphragm to the base of said valve assembly; and (c) a flexible portion connecting the fixation portion and the at least one sealing portion, characterized in that, the sealing portion comprises a rigid ring structure.

2. The diaphragm according to claim 1, characterized in that the flexible portion is continuous.

3. The diaphragm according to claim 1, characterized in that the diaphragm comprises an elastomeric material.

4. The diaphragm according to claim 1, characterized in that the rigid ring structure is at least partially coated with elastomeric material.

5. The diaphragm according to claim 1, characterized in that the fixation portion is provided with an inwardly extending rim.

6. A valve assembly comprising a housing with a valve seat surrounding a valve port and a base engaged in close fit in the housing, said valve assembly further comprising a diaphragm fixed to the base, said diaphragm comprising:

(a) at least one sealing portion suitable for sealingly fitting the valve seat, said sealing portion comprising a central opening facing the valve port;

(b) a fixation portion suitable for fixing said diaphragm to the base of said valve assembly; and (c) a flexible portion connecting the fixation portion and the at least one sealing portion, characterized in that, the sealing portion comprises a rigid ring structure.

7. The valve assembly according to claim 6, further characterized in that it comprises a cup-shaped base with a wall engaged in a valve housing, whereby the valve assembly defines two separate fluid channels, an inner channel inside the base and another inside the housing but outside the base, whereby the diaphragm is fixed to the base thereby segregating both fluid channels.

8. The valve assembly according to claim 7, characterized in that said wall of the base is provided with a groove wherein the rim at the fixation portion of the diaphragm can be fitted.

9. The valve assembly according to claim 6, characterized in that the cup-shaped base is snap fitted to the valve housing.

10. A keg provided with a neck portion and comprising the valve assembly of claim 7 fixed to said neck portion having the cup-shaped base with the wall engaged in the valve housing, whereby the valve assembly defines the two separate fluid channels, the inner channel inside the base and the other inside the housing but outside the base, whereby the diaphragm is fixed to the base thereby segregating both fluid channels.

11. The diaphragm according to claim 2, characterized in that the sealing portion comprises a rigid ring structure that is at least partially coated with elastomeric material.

12. The diaphragm according to claim 3, characterized in that the sealing portion comprises a rigid ring structure that is at least partially coated with elastomeric material.

13. The valve assembly according to claim 7, characterized in that the cup-shaped base is snap fitted to the valve housing.

14. The valve assembly according to claim 8, characterized in that the cup-shaped base is snap fitted to the valve housing.

15. The keg comprising the valve assembly according to claim 10, having the cup-shaped base with the wall engaged in the valve housing, whereby the valve assembly defines the two separate fluid channels, the inner channel inside the base and the other inside the housing but outside the base, whereby the diaphragm is fixed to the base thereby segregating both fluid channels, characterized in that said wall of the base is provided with a groove wherein a rim at the fixation portion of the diaphragm can be fitted.

16. The keg comprising the valve assembly according to claim 15, having the cup-shaped base with the wall engaged and rigidly fixed to the in the valve housing, whereby the valve assembly defines the two separate fluid channels, the inner channel inside the base and the other inside the housing but outside the base, whereby the diaphragm is fixed to the base thereby segregating both fluid channels.

* * * * *